US009017271B2

(12) United States Patent
Nef et al.

(10) Patent No.: US 9,017,271 B2
(45) Date of Patent: Apr. 28, 2015

(54) SYSTEM FOR ARM THERAPY

(75) Inventors: Tobias Nef, Zuckenriet (CH); Andreas Brunschweiler, Zürich (CH); Robert Riener, Wangen (CH); Niklaus Schulz, St. Gallen (CH)

(73) Assignee: Eidgenossische Technische Hochschule Zurich, Zurich (CH)

( * ) Notice: Subject to any disclaimer, the term of this patent is extended or adjusted under 35 U.S.C. 154(b) by 853 days.

(21) Appl. No.: 12/739,801

(22) PCT Filed: Oct. 10, 2008

(86) PCT No.: PCT/EP2008/008556

§ 371 (c)(1),
(2), (4) Date: Apr. 26, 2010

(87) PCT Pub. No.: WO2009/052958

PCT Pub. Date: Apr. 30, 2009

(65) Prior Publication Data

US 2010/0249673 A1 Sep. 30, 2010

(30) Foreign Application Priority Data

Oct. 24, 2007 (EP) ..... 07020795

(51) Int. Cl.
*A61H 1/02* (2006.01)

(52) U.S. Cl.
CPC ..... *A61H 1/0281* (2013.01)

(58) Field of Classification Search
USPC ..... 601/5, 23, 24, 26, 33; 623/24, 25, 26, 623/66.1; 602/5, 16, 19, 20, 26
See application file for complete search history.

(56) References Cited

U.S. PATENT DOCUMENTS

| | | | | |
|---|---|---|---|---|
| 3,449,769 | A | 6/1969 | Mizen | |
| 6,676,612 | B1 * | 1/2004 | Beny et al. | 601/5 |
| 7,862,524 | B2 * | 1/2011 | Carignan et al. | 601/5 |
| 7,955,285 | B2 * | 6/2011 | Bonutti et al. | 602/16 |
| 8,591,441 | B2 * | 11/2013 | Bonutti et al. | 602/16 |
| 2006/0150753 | A1 | 7/2006 | Massimo | |
| 2007/0225620 | A1 | 9/2007 | Carignan | |
| 2009/0062698 | A1 * | 3/2009 | Einav et al. | 601/5 |

FOREIGN PATENT DOCUMENTS

| | | | |
|---|---|---|---|
| FR | 2661333 | A | 10/1991 |
| WO | 9532842 | A1 | 12/1995 |
| WO | 2006058442 | A1 | 6/2006 |

* cited by examiner

*Primary Examiner* — Quang D Thanh
(74) *Attorney, Agent, or Firm* — Browdy and Neimark, PLLC

(57) ABSTRACT

A system for arm therapy comprises a first drive (M2) that can be fixedly connected to an element (10) determining the position of a user (19) and rotationally driving, about a first axis (A2), a part (21, 22, 23, 24, 25, M1, 26) of the arm therapy system which can be connected to an upper arm module (26, M3, M4). The driven part of the arm therapy system comprises a second drive (M1) adapted to rotationally drive said upper arm module (26, M3, M4) about a second axis (A1), wherein said second axis (A1) is oriented orthogonal to the first axis (A2). The system can provide a statically determined exoskeleton with correct anatomical axes and misaligned technical axes.

9 Claims, 7 Drawing Sheets

SYSTEM FOR ARM THERAPY

TECHNICAL FIELD OF THE INVENTION

The invention relates to a system for arm therapy, with a first drive that can be fixedly connected to an element determining the position of a user and rotationally driving, about a first axis, a part of the arm therapy system which can be connected to an upper arm module.

PRIOR ART

WO 2006/058442 discloses a system to improve the muscle strength and movement coordination of patients suffering from neurological deficits or from orthopaedic impairments showing the features of the preamble of claim 1. Arm therapy using such a device also has positive effects in the treatment of stroke patients.

To allow the training of activities of daily living, a system must be able to move the patient's arm in all relevant degrees of freedom and to position the human hand at any given point in space. This can be achieved by an end-effector based robot or by an exoskeleton type device. The above mentioned prior art device relates to an exoskeleton type device. It uses one degree-of-freedom movement for the glenohumeral joint (GH joint), is anatomical correct, but does not provide a shoulder guidance. It can not be converted for left/right use easily, but has the advantage to be cost-effective in comparison to other prior art devices.

End-effector based robots are connected with the patient's hand or forearm at one point. From a mechanical point of view, these robots are easier to realize. However, one drawback of such a device resides in the fact that the technical rotation axis of the robot is selected arbitrary and do generally not correspond with the rotation axis of the human joints. Adaptability to different body sizes and left- and right-arm use is easier in an end-effector based system, i.e. where the system moves the arm by inducing forces only on the patient's hand.

In contrast, the structure of exoskeleton robots resembles the human arm anatomy. Consequently, the arm is attached to the exoskeleton at several points. Exoskeletal systems are more difficult to adjust, because each robot link must be adjusted to the corresponding patient arm segment. However, the advantage of an exoskeleton system compared to the end effector-based approach is that the arm posture is statically fully determined. Torques applied to each joint can be controlled separately and hyperextensions can be avoided by mechanical stops. The possibility to control torques in each joint separately is essential, e.g. when the subject's elbow flexors are spastic. This involuntary muscle activation results in an increased resistance against movements. To overcome the resistance, elbow torque up to 20 Nm is necessary. This must not induce any reaction torques or forces in the shoulder joint, which can be guaranteed by an exoskeleton robot but not by an end-effector based one. This is important because the shoulder girdle is a rather instable joint and the head of the humerus bone is hold in its position by muscles and tendons and not by ligaments and bones. If one applies high shear forces to the shoulder joint, humerus head dislocation can occur.

That is the reason why therapists use both hands when they mobilize a spastic elbow joint. With the goal to avoid to exercise forces to the shoulder, one hand holds the lower arm while the other hand holds the upper arm—comparable to exoskeleton robots with a cuff fixed to the lower arm and a cuff fixed to the upper arm.

SUMMARY OF THE INVENTION

It is common practice in upper limb rehabilitation robotics to simplify the human shoulder joint to a three degree of freedom ball and socket joint. This oversimplification of the human joint kinematics leads to a misalignment between robots and human limb. While this simplification is nearly correct for small angles exerted or exclusive glenohumeral motion, it significantly deviates during larger motions. Therefore, combined movement of robot and human will be heavily disturbed. It is therefore one aim of the invention to provide a solution for this problem of the human shoulder movement.

The human shoulder complex is properly divided into two interconnected sub-systems. First is the innermost proportion of the shoulder complex, referred to as the shoulder girdle. It consists of the sternum/thorax/torso, clavicle and scapula. Second is the outermost proportion of the shoulder complex, the glenohumeral joint. The glenohumeral joint moves with the scapula of the shoulder girdle. The humerus connects to the scapula through this glenohumeral joint. The elevation of the humerus results from rotations of the humerus around the glenohumeral joint (GH-joint), from rotation of the scapula around the acromioclavicular joint (AC-joint) and from rotation of the clavicle around the sternoclavicular joint (SC-joint). As consequence, the GH-joint displacement in x-, y- and z-direction occurs during arm movement.

A device having the above mentioned features furthermore comprises a second drive adapted to rotationally drive said upper arm module about a second axis, wherein said second axis is oriented nonparallel to the first axis. Preferably, the second axis is oriented orthogonal to the first axis.

Preferably, the second axis comprises a minimal distance from the first axis and/or wherein the second axis is arranged in the dorsal direction of the user behind the first axis. This embodiment of the invention is based on the insight that an improved system can provide a statically determined exoskeleton with correct anatomical axes and misaligned technical axes. Of course said minimal distance can be chosen r=0 mm. In an embodiment of the invention it is chosen as r=41 mm. It is also possible to choose values as 20 mm or 60 mm without departing from the scope of the invention.

Using a hinged profile between the two drives, which can be pivoted about an axis parallel to said second axis and which can be fixed in two mirror-inverted positions on either side of a plane comprising the first axis, allow for a simple switching between right-arm/left-arm use of the system.

The system according to a further embodiment preferably comprises an element which can be rotated about the second axis comprising at least one fixation point for a cable outside said second axis. Then an upper arm module is affixed to said element and said cable is attached to a weight compensating elastic means being attached to a non-pivotable element of the connection between the two drives. In case of loss of power, the system is maintained approximately at an average compensated position without necessity for complicated safety measures. Additionally the drives do only have to move the arm of the user whereas the weight of the modular and replacable arm modules is compensated for.

The system furthermore preferably comprises at least one light source for generating two beams. A first beam is aligned with the first axis and a second beam is oriented in parallel to the second axis, wherein the two beams are crossing in a point designating the glenohumeral joint of the user. Of course preferably the light source(s) are lasers or focussed LED's.

Further advantageous embodiments are characterized in the dependent claims.

Furthermore, it is required that the system is easy to handle and that safety is always guaranteed for both patient and therapist.

BRIEF DESCRIPTION OF THE FIGURES

The invention is now explained in greater detail on the basis of illustrative embodiments and with reference to the attached drawings, in which.

DETAILED DESCRIPTION OF THE PREFERRED ILLUSTRATIVE EMBODIMENTS

Training of activities of daily living (ADL) includes tasks like eating, drinking, combing hair, etc. For most of these ADL tasks, the hand has to reach a point in space, grasp an object, and then control position and orientation of the object until the task is completed. Therefore, the system must be able to support movements of the shoulder, the elbow, and the wrist. Approximating the shoulder by a three degrees-of-freedom (DOF) ball-and-socket joint, and allowing elbow flexion/extension, pro/supination of the lower arm and wrist flexion/extension, results in a device with at least six active DOF.

According to one embodiment of the invention a system according to the invention can be built with four active DOF supporting the movements of the shoulder joint and elbow flexion/extension.

The range of motion (ROM) must match as close as possible the ROM of the human arm. In order to obtain a satisfactory control performance of model-based patient-cooperative control strategies, the system must has low inertia, low friction and negligible backlash. Furthermore, the motor/gear unit are backdrivable.

The preferred requirements for the range of motion (ROM), velocity and the maximal torques are laid down in the following table. It is of course possible to reduce or enlarge the range of motion, the torque and acceleration for specific applications.

| Axis | ROM | Torque | Acceleration | Velocity | Static Friction |
|---|---|---|---|---|---|
| Arm Elevation $\theta_1$ | 45° . . . 135° | 20 Nm | 60°/s$^2$ | 30°/s | >6 Nm |
| Horizontal sholder rotation $\theta_2$ | −45° . . . 135° | 20 Nm | 60°/s$^2$ | 30°/s | Low |
| Internal/external sholder rotation $\theta_3$ | −90° . . . 90° | 10 Nm | 40°/s$^2$ | 20°/s | >3 Nm |
| Elbow flexion/ extension $\theta_4$ | 0° . . . 120° | 20 Nm | 120°/s$^2$ | 60°/s | Low |

The velocities and accelerations have been determined by measuring the movements of a healthy subject during two ADL tasks (eating soup and manipulating of a coffee cup). Faster movements are usually not contemplated. These values served as input for a simple dynamic model applied to estimate the required joint torques. In order to assure that the system will be strong enough to overcome resistance from the human against movements due to spasms and other complications that are difficult to model, rather high values have been selected. The required endpoint payload is 1 kg and endpoint position repeatability is 10 mm. These values allow manipulation of objects like a coffee cup.

Figure 1:
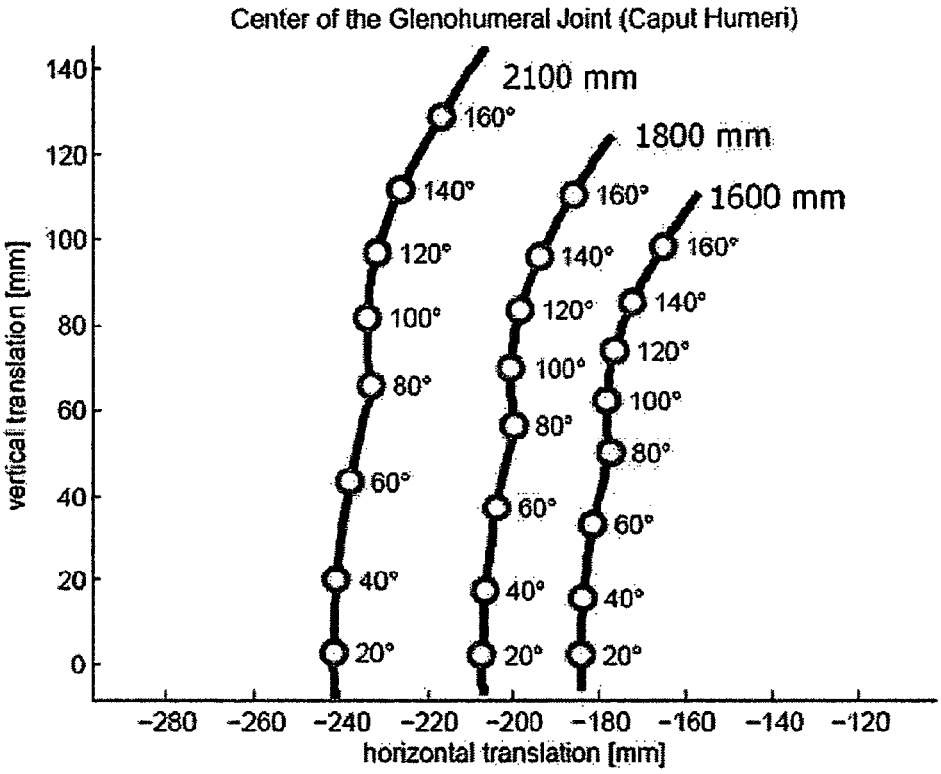
FIG. 1 shows a graphical representation of the movement of the centre of the glenohumeral joint for different body sizes.

FIG. 1 shows a graphical representation of the movement of the centre of the glenohumeral joint for different body sizes.

Figure 2:
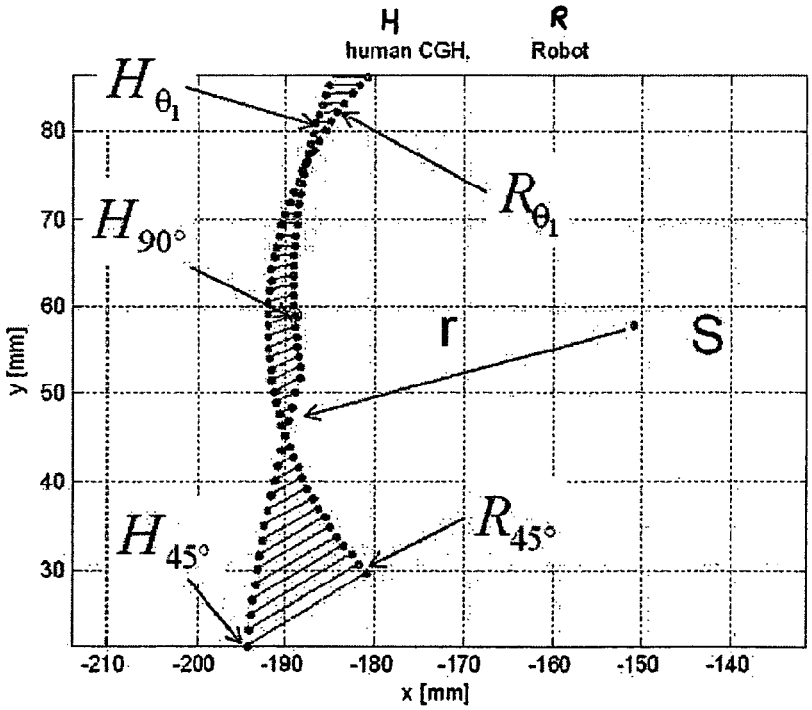
FIG. 2 shows the movement of the CGH joint of the human and the movement of the robot, that results from the rotation around the centre S.

It is the approach of the invention to reduce the movement of the centre of the glenohumeral joint (CGH) to a 1 DOF rotatory movement. The methodology is to replace the movement of the CGH joint by a rotation around a fixed centre of rotation using the required range of motion. The relevant angle is chosen between $\theta_1$=45° and $\theta_1$=135°. FIG. 2 shows the movement of the CGH joint of the human and the movement of the system that results from the rotation around the centre S for the interesting range of motion. The mean error between the two trajectories, calculated for discrete values of the arm elevation angle is given by $$E = \sum_{\theta_1=45°}^{\theta_1=135°} \left(\sqrt{(H_{\theta_1 x} - R_{\theta_1 x})^2} - \sqrt{(H_{\theta_1 y} - R_{\theta_1 y})^2}\right) \frac{1}{135° - 45°}$$

with $$R_{\theta_1} = f(S_x, S_y, r)$$

The resulting optimization problem consists of finding the x and y coordinate of the centre S and the radius r that minimizes the mean error E. The numerical optimization is performed for a subject with body size h=170 cm. Results can then be scaled for other body sizes.

$H_{\theta 1}$ marks the position of the CGH joint for a specific arm elevation angle $\theta_1$ and R marks the position of the movement of the virtual CGH joint of the robot for the corresponding arm elevation angle $\theta_1$. In the idle case, the two trajectories coincide.

The mean position error for different values for Sx and Sy are calculated with a constant radius r=41 mm. The minimal value for E has the coordinates (−151 mm, 58 mm, 3.81 mm).

Figure 3:
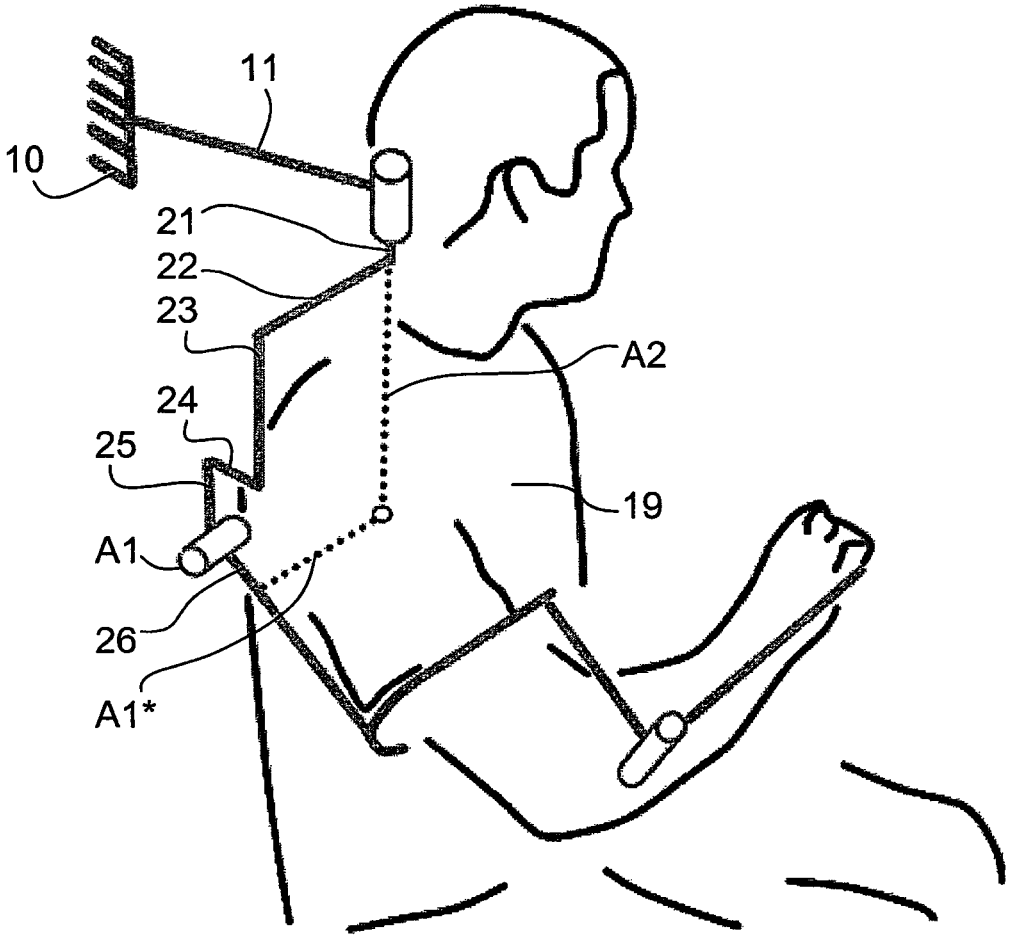
FIG. 3 shows a very schematic perspective view of the overall system according to one embodiment of the invention, together with a schematically depicted patient.

The mean error of the kinematics is 4.2 mm and the maximal error 15 mm, and lies in the same range as the resulting mean error of the numerical optimization. With this methodology, the movement of the centre of the glenohumeral joint has been simplified to a rotatory movement around the fix centre of rotation S allowing to simplify the kinematics of the shoulder actuation of the system to a mechanical structure as shown in FIG. 3. FIG. 3 looks similar to the arm exoskeleton according to WO 2006/058442, with the difference that the axes of motor M1 (arm elevation) and motor M2 (horizontal arm rotation) do not intersect, because motor M2 is displaced backwards by the distance r (r=41 mm for h=1700 mm). Therefore the CGH joint is aligned with the axis of motor M1 but not with the axis of motor M2. This makes that the CGH joint travels on a circular trajectory upwards/downwards during arm elevation/depression.

The structure can be attached to a wall 10, i.e. M2 is connected with a beam 11 to the wall 10. It is also possible that element 10 is adjustable in height, i.e. the position of motor M2 in vertical direction is adjustable. Wall 10 can of course be replaced by a mobile platform, a chair or the attachment point can be affixed to the user's back. Profile 21 is connected with motor M2 for an axial rotation. Preferably, axis A2 of motor M2 is a vertical axis, being in parallel to the anteriorposterior or rostrocaudal axis of user 19. Profile 23 is connected via profile 22 with the drive shaft of motor M2 and thus defines the rotational movement of profile 23 about axis A2.

Profile 24 provides the distance of radius r communicated to motor M1 via profile 25. Thus motor M1, oriented in parallel to axis A1* which is perpendicular to axis A2, is not in line with axis A2 but a distance r behind, i.e. in the direction of the dorsal side of the user 19, as it can be seen from the intersection of axis A2 with profile 26. Axes A1 and A1* are preferably horizontal axes. A Profile 26 connects the above mentioned structure to the rotation module for the upper arm of a user 19, comprising a cuff and motor M3 as well as the module for the lower arm of the user 19, comprising motor M4. Motors M3 and M4 can be chosen and arranged according to WO 2006/058442 or another prior art device.

However, a simpler embodiment of the invention can use a value for the radius of r=0 mm, i.e. that the axis A1 is equal to axis A1* and that the two axis intersect.

Figure 4:
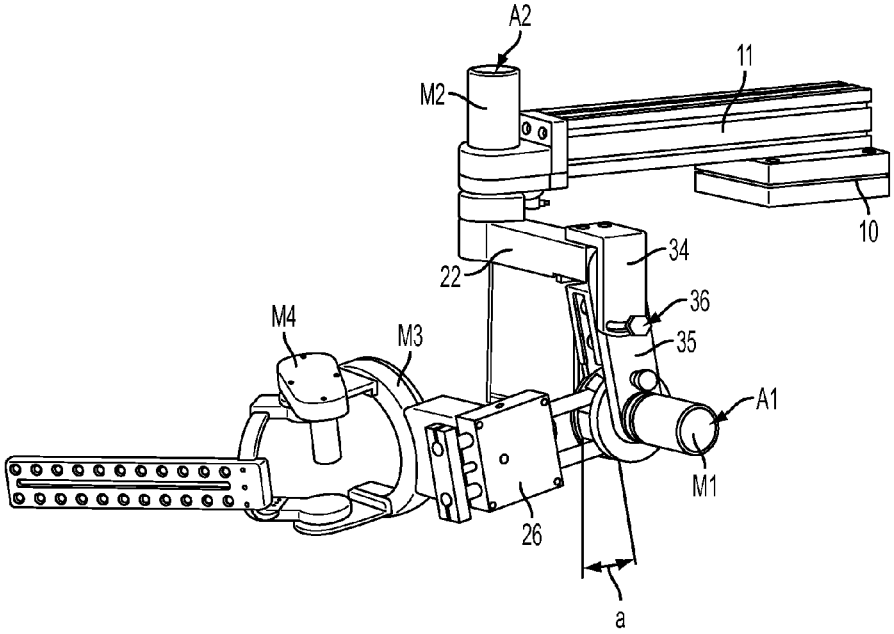
FIG. 4 shows a schematic perspective view of the overall system according to one embodiment of the invention.

A slightly different embodiment is shown in FIG. 4, providing the further advantage of the device according to the invention to adapt it easily for a right arm and a left arm use. Identical features receive in all Fig. the same reference numerals. Further different arrangements of the profiles are possible, as long as motor M1 and rotate motor M2, wherein the axis of the motors are in a skew relationship.

Profiles 24 and 25 from FIG. 3 are replaced by a hinged element 35. Element 35 can be rotated about an axis being in parallel with profile 22. Thus the axis A1 of motor M1 can be arranged in the position shown in FIG. 4, being nearer to wall 10. Hinged element 35 comprises a fixation screw 36 protruding through a slit in element 34 allowing the above mentioned fixation.

In other words the element 35 can be pivoted about an axis parallel to said second axis A1 and can be fixed in two mirror-inverted positions on either side of a plane comprising the first axis A2 and being parallel to second axis A1. In particular, there is one light source is generating two beams (41, 42}, a first beam (41) aligned with the first axis (A2) and a second beam (42) oriented in parallel to the second axis (A1), wherein the two beams (41, 42) are crossing in a point (43) designating the glenohumeral joint of the user (19). Further, the second beam is oriented along a misaligned second axis A1* being in parallel to the second axis A1], preferably using a light guide 44 attached to a non-pivotable element 22 of the connection between the two drives (M2, M1).

The embodiment shown in FIG. 4 illustrates the switch from a position to use the system with the right arm to the other position to use the system with the left arm. In order to use the system for the right and the left arm, the non-symmetric, sharp break of length r in FIG. 3 is replaced by a rotation of the vertical link that holds motor M1 around the horizontal link, coming from motor M2, as can be seen in FIG. 4. The angle α between the two links can be varied from −15° to 15° and this angle α is determined by the distance r that depends on the patient's body size:

$$r = r_{170}\frac{h_{body}}{170\ \text{cm}} = 4.1\ \text{cm}\frac{h_{body}}{170\ \text{cm}}$$

$$\alpha = \arcsin\left(\frac{r}{l}\right) = \arcsin\left(4.1\ \text{cm}\frac{h_{body}}{170\ \text{cm}}\right)$$

with l being the length of the vertical link 35 that holds motor M1 and $r_{170}$ chosen to be 41 mm.

Figure 6:
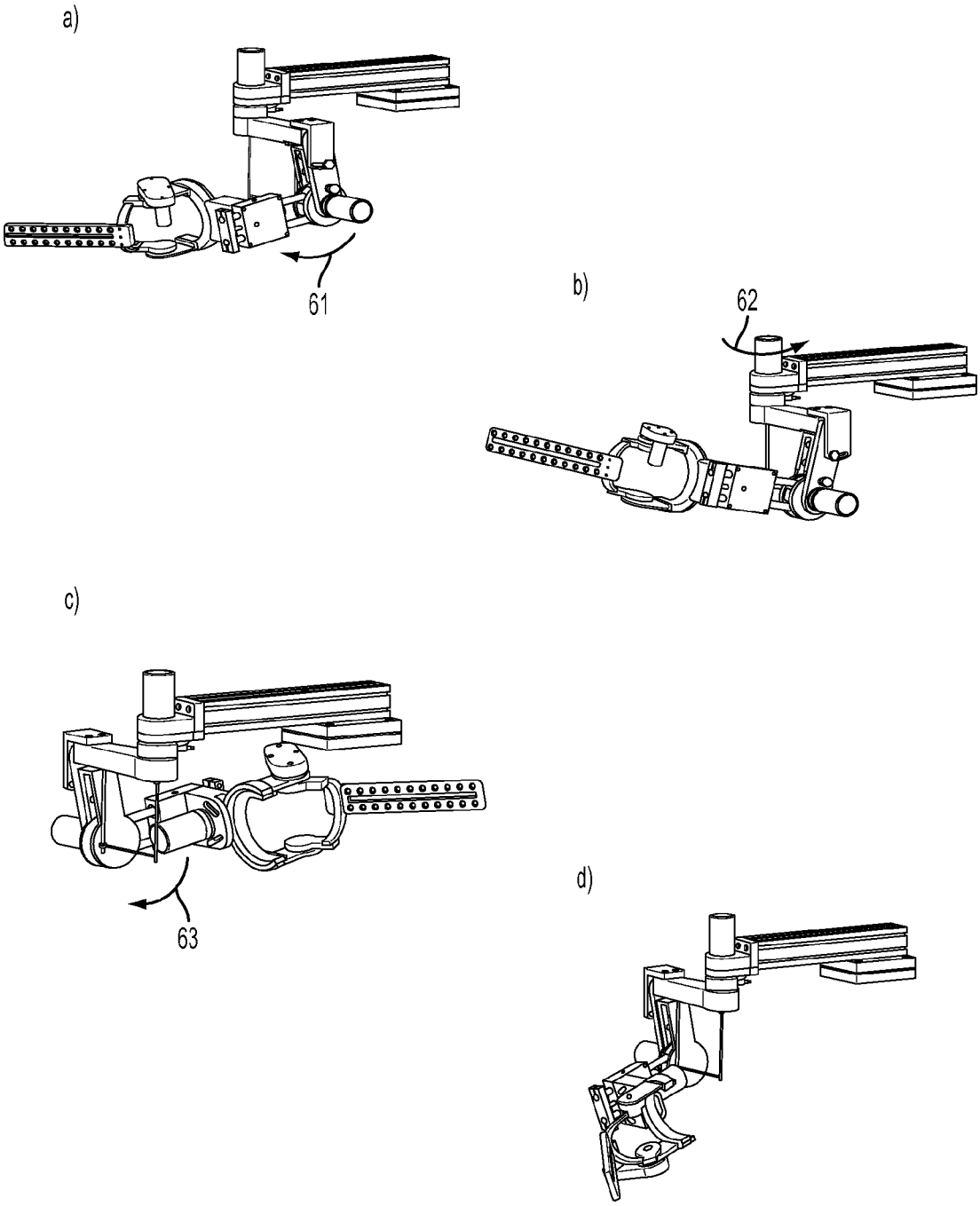
FIG. 6 shows the procedure of transformation from left arm use to right arm use.

Now FIG. 6 is considered showing the procedure of transformation from left arm use to right arm use, when no human arm is connected to the system. The kinematics can now be transformed from left arm use to right arm use and vice-versa without requiring any complex manipulation. This transformation requires three steps as shown in FIG. 6, starting with the configuration in FIG. 6*a*. First, the axis A1 is rotated around the horizontal link which corresponds to a sign change of the angle α according to arrow 61 and a fixation in the new position leading to the configuration of FIG. 6*b*. Second, the distal part of the orthosis is rotated around the axis of motor 2 and switched to the other side according to arrow 62 for an amount of approx. 180° leading to the configuration of FIG. 6*c*. Third, the same piece is rotated around the axis A1 of motor M1 according to arrow 63 in order to point forward leading to the configuration of FIG. 6*d*.

As for safety reasons, it is required that the range of motion of every single axis is mechanically limited to the anatomical range of the human arm, two additional manipulations are necessary. This is first to remove a steal bolt that limits the range of motion of axis A2 and replace it afterwards and second, to remove and replace a further steal bolt that limits the range of motion of axis A1. Both steal bolts are installed in such way that the user cannot forget to replace them.

Figure 5:
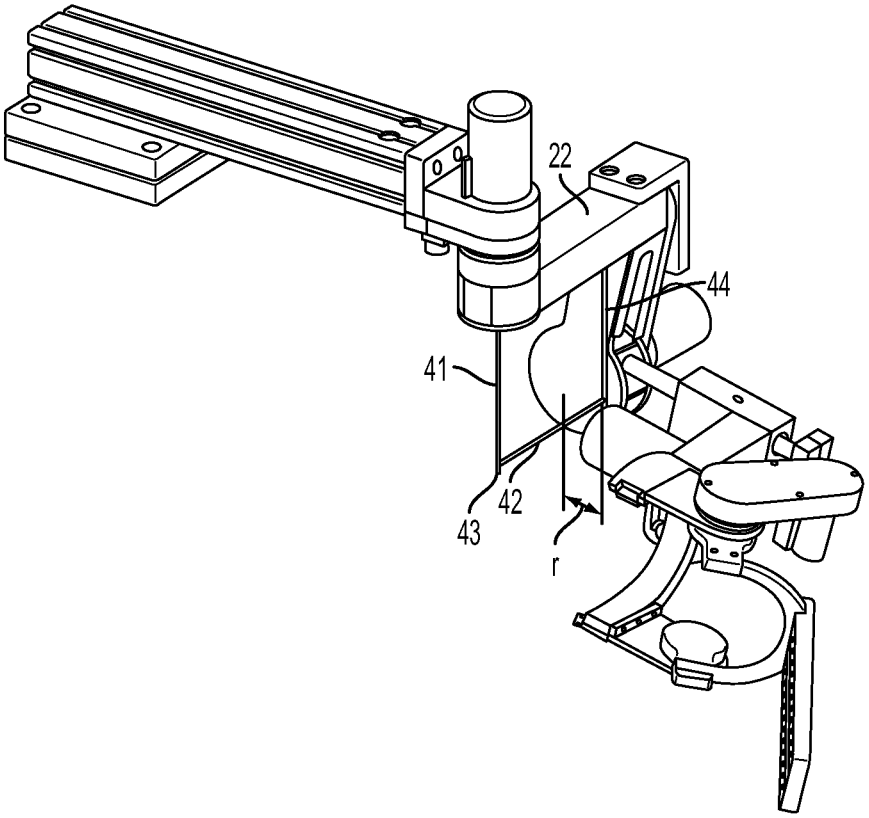
FIG. 5 shows a different perspective view of the system of FIG. 4.

FIG. 5 shows an additional improved embodiment of the invention. The features mentioned below can be used in connection with the features as shown in FIG. 4 or in connection with the features as shown in FIG. 3 or with the simpler embodiment with r=Omm. A light source is provided, emitting light 41 directly or indirectly along the axis A2 of motor M2. It is preferred to provide a laser beam showing almost no divergence. A further light beam emitted by a second light source or a derived light beam 42, preferably outcoupled from a fibre, guided through conduit 44, is directed parallel to profile 22 in a distance of said second axis A1 so that the two laser beams 41 and 42 mark the position of the centre of the glenohumeral joint that needs to be positioned at the intersection point 43 of the two beams. Beam 41 is in line with the axis A2, and beam 42 is parallel to axis A1 with the distance r. A therapist working with a user 19 of the system will initially check the direction of the beams 41 and 42 in space and use the intersection point 43 to place the glenohumeral joint of the user 19 correctly in space. Of course, while guiding the shoulder and arm of the user 19, the beams 41 and 42 are partially blocked by the user 19 and will be visible on skin or cloth of said user 19 as visualization means. It is also possible to only use one single beam 41 or 42, giving one direction. In a further embodiment, there is provided a pivoting unit 45 enabling the light source (or a light guide) to be pivoted by 90 degree to switch from a first position, wherein beam 41 (defined by its direction) is emitted, to a second position wherein beam 42 (defined by its direction) is emitted. In other words, said unit switches the direction of the single light beam between a first orientation where it is aligned with the first axis A2 and a second orientation where it is oriented in parallel to the second axis A1.

Axis A2 is preferably composed of a DC-motor that is connected to the harmonic drive gearbox. Beside a DC-motor, the motors M1 and M2 can be chosen as AC-motors or as pneumatic or hydraulic drives to name a few possibilities for useful drives. Followed by the six DOF force/torque sensor, this degree of freedom actuates horizontal shoulder rotation. Axis A1 is composed of the same motor/gear unit and does actuate arm elevation. Axis A3 can be driven by a drive similar to the one that has been used with the system shown in WO 2006/058442. This degree of freedom does actuate internal/external shoulder rotation. Axis A4 drives elbow flexion/extension angle. This degree of freedom is actuated by a DC motor, followed by a tooth belt that transmits the rotation to the input of the harmonic drive gearbox that is connected to elbow link. This transmission is necessary because, depending on the body side the device is used, the actuator is either above (left arm use) or below (right arm use) of the elbow joint. The motor is not to be mounted directly onto the harmonic drive gearbox because it would collide with the human body in case of right arm use of the robot.

Figure 7:
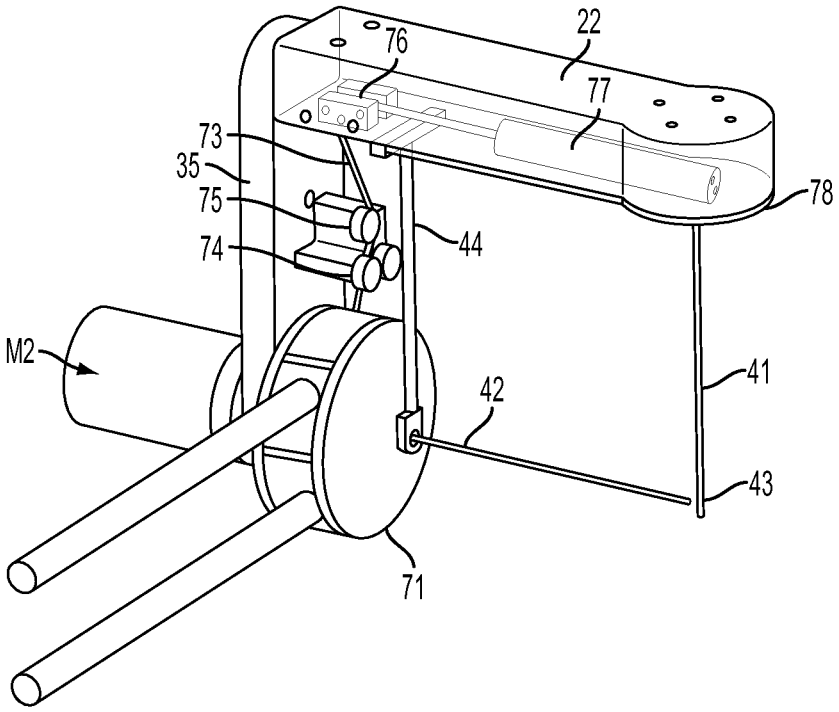
FIG. 7 shows a perspective view of an adaptable weight compensation for the axis A2.
Figure 8:
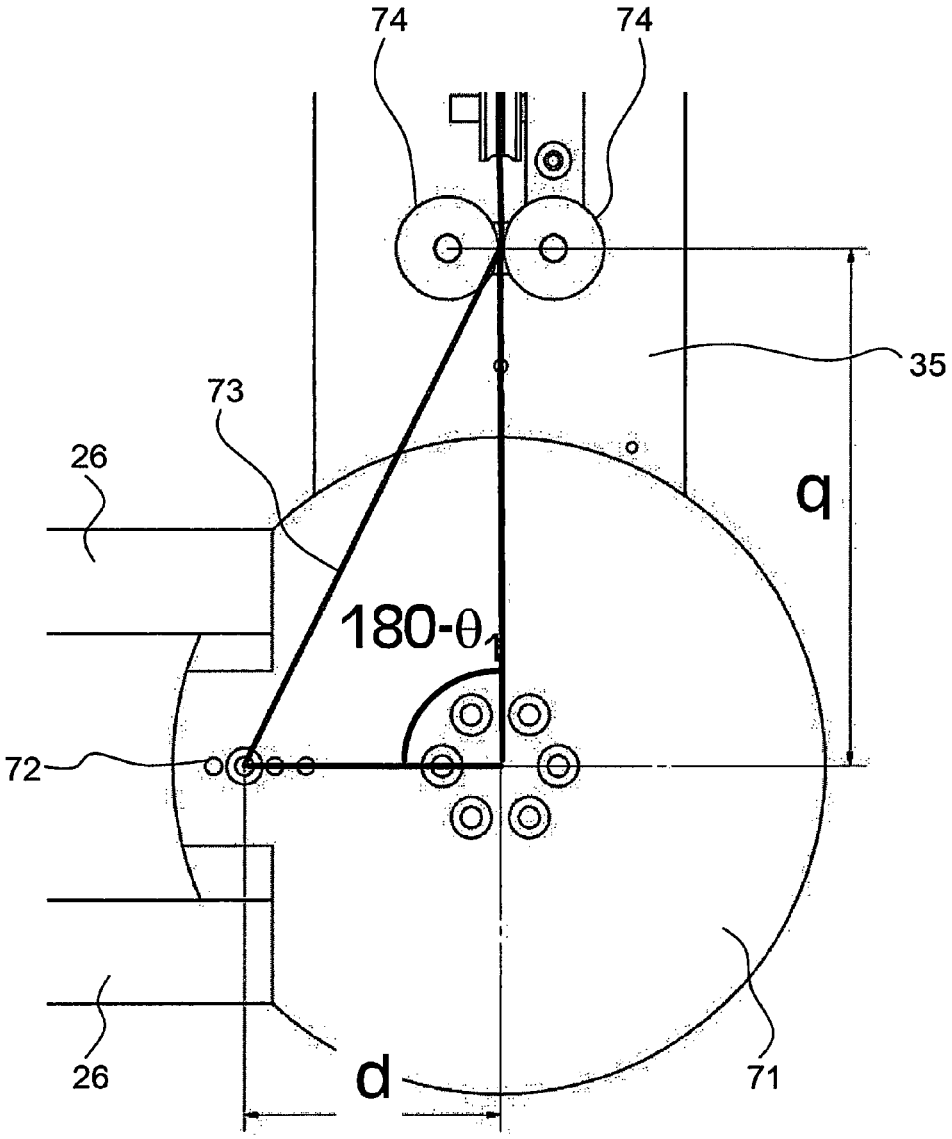
FIG. 8 shows a schematic side view of the unit according to FIG. 7.

A further embodiment is shown in connection with FIGS. 7 and 8. For safety reasons, it is furthermore preferable that the rotation around axis A1 (arm elevation) is weight compensated. This is important because in case of power loss, the arm of the patient and the robot must not fall down due to gravity. Moreover, the passive weight compensation has also the welcome side effect that the continuous torque of motor 1 is significantly reduced. It is possible to use counterweights. Because of the added inertia, another solution is conceived as further embodiment of the system.

FIG. 7 shows a perspective view of an adaptable weight compensation for the axis A2 according to said further embodiment. The spring exercises the torque $\tau_s$ onto axis A1. $M_s$ depends on the angle $\theta_1$, the distance d of the cable fixation from the centre and the distance q of the pulley from the centre, and from the spring constant k. FIG. 8 shows a schematic side view of the unit according to FIG. 7.

A turning plate 71 is mounted for rotation about axis A1. Turning plate 71 supports the profiles 26 for attachment of the upper and lower cuff structure, providing a considerable weight for the system. As it can be seen in FIG. 8 four holes 72 are provided on the radius line between the profiles 26, providing four attachment points for a cable 73. Cable 73 is guided between pulleys 74 also providing guidance for the cable 73. Further pulleys 75 and 76 divert the cable 73 into the hollow profile 22 wherein it is attached to a spring 77 and which spring is attached to the profile 22 with a screw 78. Thus the position of the cable can be adjusted through turning the screw 78 thus changing the fixation point of the spring 77 along the axis of the cable 73. The tension spring 77 is one embodiment of a weight compensating elastic means, which can also be realized through different springs as compression springs, Belleville spring washer or similar means. In particular, at least one element (71) which can be rotated about the second axis (A1) comprising at least one fixation point (72) for a cable (73) outside the second axis (A1), wherein the upper arm module (26, M3, M4) is affixed to the element (71), and the cable is attached to a weight compensating elastic means (77), wherein the elastic means {77) is attached to a nonpivotable element (22) of the connection between the two drives (M2, M1).

Said weight compensation must compensate for maximal torque $\tau_r$ that the system exercises onto axis A1 due to the gravity acting onto the system for the case of fully extended elbow (=0°). It is $$\tau_r = r_{cg} mg \sin(180° - \theta_1)$$

with $r_{cg}$ being the distance of the centre of the gravity of the distal part of the exoskeleton, m the mass of the distal part, g the gravity constant and $\theta_1$ the arm elevation angle. Note that the torque varies with the arm elevation angle. The torque that the spring delivers onto the axis A1 is given by:

$$\tau_s = dqk \sin(180° - \theta_1)$$

with d being the distance of the cable fixation from the centre to the chosen hole 72 and q being the distance of the pulley 74 from the centre and k being the spring constant. As the torques must be equal, the following equation can be used to determine the values for d, q and k:

$$\tau_s = \tau_r \Leftrightarrow dpk = rmg$$

It is noted that the weight compensation is correct for all arm elevation angles and that the transformation from left arm use to right arm use is still possible. Furthermore, the value of the weight compensation can be adjusted for different values of $r_{cg}$ and m. This is important as it must be possible to add different distal modules for lower arm actuation to the device. Adjustments are possible by changing the spring constant k, meaning to replace the spring, the spring pre-constraint can be adjusted and four discrete values for d are possible (here four screw positions, but also different number of positions are possible).

The system used for the experiments illustrated herein used the following equipment:

a.) Sensors
- Position: One encoder (min. req. resolution: 0.001°) and one potentiometer (min. req. resolution: 1°) per axis.
- Force/Torque: One optional 6 DoF load cell.

b.) Handling
- Left/right switch easily possible according to FIG. 4/5.

c.) Safety
- Appropriate counterweight for axis A1 according to FIG. 7/8, ensuring that the robot does not collapse when the motors are not powered.
- Fix installed mechanical end stops for the boarders of the anatomical ranges.
- No end-stop button required and used.

d.) Shoulder
- Vertical shoulder deviation compensated.
- Horizontal shoulder displacement ignored.

e.) Cuffs
- Upper arm cuff inside the rotation module similar to WO 2006/058442
- Lower cuff close to hand The presented kinematics of the system provides anatomical correct shoulder actuation, easy left/right side use and is furthermore easy to use for the therapist because the patient-position is defined by the laser beams. However, it is also possible to use an embodiment using the features of FIG. 3 alone the invention or it is possible only to combine the features of FIG. 3 and FIG. 4/5 or the features of FIG. 3 and FIG. 7/8.

In case that r<>0, it is of course possible to choose different profiles to connect the motors M1 and M2. The connection can be a curved one instead the L-profile as represented or simply an oblique profile. Such a profile configuration can replace the linking profiles 21, 22, 23, 24 and 25.

The embodiments can therefore be classified according to the following table. Straight lines in a space are referred to as skew if they are neither parallel nor intersecting.

| Radius | Relation of axes A1 and A1* | Orientation of A1 and A2 in space |
|---|---|---|
| r = 0 | A1 = A1* | A1 and A2 are intersecting and enclose a 90° angle (orthogonal) |
| r = 0 | A1 = A1* | A1 and A2 are intersecting and enclose an angle <> 90° |
| r <> 0 | A1 <> A1* | A1 and A2 are not intersecting, they enclose a 90° angle in a plane being a projection of one axis onto the other (skew) |
| r <> 0 | A1 <> A1* | A1 and A2 are not intersecting, they are not parallel one to the other and there is no projection plane, within which they enclose a 90° angle (skew) |

The invention claimed is:

1. A system for arm therapy, having:

an upper arm module comprising:

a driven part of the arm therapy system connected to the upper arm module;

a first drive fixedly connected to an element determining a position of a user and rotationally driving, about a first axis, the driven part, a second drive associated to the driven part and to rotationally drive said upper arm module about a second axis, and a profile providing the connection between the first drive and the second drive, at least one light source for generating two light beams, a first beam being aligned with the first axis and a second beam oriented in parallel to the second axis, and wherein the two beams are crossing in a point designating the glenohumeral joint of the user, wherein said second axis is oriented nonparallel to and nonintersecting with the first axis, wherein the second axis extends a predetermined distance from the first axis and wherein the second axis is arranged in the dorsal direction of the user behind the first axis, and wherein the first drive is oriented in parallel to an anterior-posterior or rostrocaudal axis of the user.

2. The system according to claim 1, wherein the second beam is oriented along a misaligned second axis being in parallel to the second axis, preferably using a light guide attached to a non-pivotable element of the connection between the two drives.

3. The system according to claim 1, wherein the light source is a laser.

4. A system for arm therapy, having:

an upper arm module comprising:

a driven part of the arm therapy system connected to the upper arm module;

a first drive fixedly connected to an element determining a position of a user and rotationally driving, about a first axis, the driven part, a second drive associated to the driven part to rotationally drive said upper arm module about a second axis, and a profile providing a connection between the first drive and the second drive, wherein the profile maintains said second axis oriented nonparallel to and nonintersecting with the first axis while the first drive is actuated, wherein the second axis extends a predetermined distance from the first axis and wherein the second axis is arranged in the dorsal direction of the user behind the first axis, and wherein the first drive is oriented in parallel to an anterior-posterior or rostrocaudal axis of the user.

5. The system according to claim 4, wherein the profile is a hinged profile which can be pivoted about an axis parallel to said second axis and which can be fixed in two mirror-inverted positions on either side of a plane comprising the first axis.

6. The system according to claim 4, wherein said driven part of the arm therapy system can be pivoted and fixed about the first axis in two mirror-inverted positions on either side of an axis being in parallel to a dorsoventral axis of the user and wherein the upper arm module can be pivoted around the second axis for switching the system from right arm use to left arm use and vice-versa.

7. A system for arm therapy, having:

an upper arm module comprising:

a driven part of the arm therapy system connected to the upper arm module;

a first drive configured to be fixedly connected to an element determining the position of a user and rotationally driving, about a first axis, the driven part, a second drive associated to the driven part and configured to rotationally drive said upper arm module about a second axis, a weight compensating elastic element, a cable attached to said weight compensating elastic element, at least one rotatable element configured to be rotated about the second axis comprising at least one fixation point for said cable outside said second axis, and a profile configured to provide a connection between the first drive and the second drive and having a non-pivotable element, wherein said second axis is oriented nonparallel to the first axis, wherein the upper arm module is affixed to said rotatable element, and wherein said weight compensating elastic element is attached to the non-pivotable element of the profile between the two drives.

8. The system according to claim 7, wherein the weight compensating elastic element is a torsion spring attached to said non-pivotable element via a tension adjusting screw.

9. The system according to claim 7, wherein there are two or more fixation points provided on a radius line of the rotatable element which radius line is positioned near a horizontal line in a weight compensated state when an upper arm module is mounted.

* * * * *